United States Patent [19]

Fujita et al.

[11] Patent Number: 4,962,291

[45] Date of Patent: Oct. 9, 1990

[54] APPARATUS FOR PRODUCTION METAL POWDER HAVING A SHIELDED RUNNER NOZZLE GATE

[75] Inventors: Senji Fujita, Nagoya; Noboru Demukai, Gifu, both of Japan

[73] Assignee: Daido Tokushuko Kabushiki Kaisha, Nagoya, Japan

[21] Appl. No.: 403,440

[22] Filed: Sep. 6, 1989

[30] Foreign Application Priority Data

Sep. 7, 1988 [JP] Japan ..... 63-224296

[51] Int. Cl.[5] ..... H05B 6/40

[52] U.S. Cl. ..... 219/10.491; 219/7.5; 219/10.43; 219/10.79; 75/10.14; 75/10.17; 425/174.8 R

[58] Field of Search ..... 219/7.5, 6.5, 10.43, 219/10.491, 10.57, 10.75, 10.79; 75/0.5 C, 10.14, 10.15, 10.17; 425/6, 7, 10, 174.8 R

[56] References Cited

U.S. PATENT DOCUMENTS

| | | | |
|---|---|---|---|
| 2,448,690 | 9/1948 | Storm | 219/10.57 |
| 4,300,031 | 11/1981 | Reboux et al. | 219/10.79 |
| 4,438,310 | 3/1984 | Cachat | 219/10.43 |
| 4,534,917 | 8/1985 | Walz | 425/7 X |
| 4,762,553 | 8/1988 | Savage et al. | 219/7.5 X |
| 4,770,718 | 9/1988 | Verhoeven et al. | 75/0.5 C |

*Primary Examiner*—Philip H. Leung

*Attorney, Agent, or Firm*—Armstrong, Nikaido, Marmelstein, Kubovcik & Murray

[57] ABSTRACT

An apparatus is disclosed for producing metal powder having a molten metal holding vessel with a generally cylindrical shaped bottom portion, a molten metal discharging runner located at the bottom portion of the holding vessel, a spraying chamber connected at a lower end of the discharging runner, a first induction heating coil having a diameter and surrounding the holding vessel, a second induction heating coil surrounding the discharging runner, and a ring-shaped magnetic shielding plate disposed between the second induction heating coil and the sliding gate. The discharging runner has a nozzle portion which includes a sliding gate made of ceramic. The sliding gate is movable for controlling the flow of the molten metal through the nozzle portion of the discharging runner. The spraying chamber has gas-jetting nozzles. The second induction heating coil has a diameter smaller than a diameter of the first induction heating coil.

3 Claims, 4 Drawing Sheets

APPARATUS FOR PRODUCTION METAL POWDER HAVING A SHIELDED RUNNER NOZZLE GATE

BACKGROUND OF THE INVENTION

1. Field of the Invention

The present invention concerns an apparatus for producing metal powder by gas-atomizing method. The apparatus is particularly useful for producing powder of special steels and super alloys, and it is possible to produce very clean metal powder with a preferable embodiment of this apparatus.

2. State of the Art

Powder metallurgy has been often used for production of tools from a high-speed steel or sintered hard alloys of a high carbon content, or production of parts of a jet-engine or a gas-turbine with a Ni-based or a Co-based super alloy. By recent progress in HIP technology and spread of the equipments of large capacities, it is getting easier to produce the parts of desired shapes and performance starting from the metal powders.

As a method of producing metal powder of low impurity contents, it has been known to atomize the molten metal with a jetting gas. The gas-atomizing method is carried out by using a molten metal atomizing appratus comprising a molten metal holding vessel equipped with a molten metal discharging runner at the bottom thereof and a spraying chamber equipped wiht gas-jetting nozzles therein. There was proposed to use a discharging runner equipped with a sliding gate at the lower end of the runner connected to the bottom of the vessel and an induction heating coil around the runner.

In the discharging runner mentioned above, when the metal in the runner is heated with the magnetic flux given by the induction coil surrounding the runner, it is often observed that the flux extends to the sliding gate to cause heating of the gate. Therefore, it is necessay to choose a heat-resistant material or a non-electroconductive material as the material of the gate. Also, consumption of the flux or loss of electric power is inevittable at the gate. If the distance is so large that the flux from the coil may not extend to the gate, then it will be possible that the molten metal solidifies in the runner.

With respect to the quality of the product metal powder, while practice of HIP at a higher temperature under a higher pressure gives products having bulk densities substantially the same as those of the ingot products, demand for better material metal powder is getting severer. In order to fully enjoy the merits of using powder metal, i.e., fine crystal grains, and fine precipitation and uniform distribution of the strengthening material such as carbides, it is necessary that the metal powder contains a very small amount of surface oxides and free from external impruitites such as pieces of refractories or slags.

The powder metal products produced by conventional gas-atomizing technologies are not satisfactory.

SUMMARY OF THE INVENTION

An object of the present invention is to provide an apparatus for producing metal powder by gas-atomizing method, which is equipped with a molten metal discharging runner, in which the sliding gate is not influenced by the flux and loss of the flux is decreased.

Another object of the present invention is to provide an apparatus for producing metal powder which enables production of very clean metal powder to meet the demand for a higher quality.

DRAWINGS

DETAILED EXPLANATION OF PREFERRED EMBODIMENTS

Figure 1:
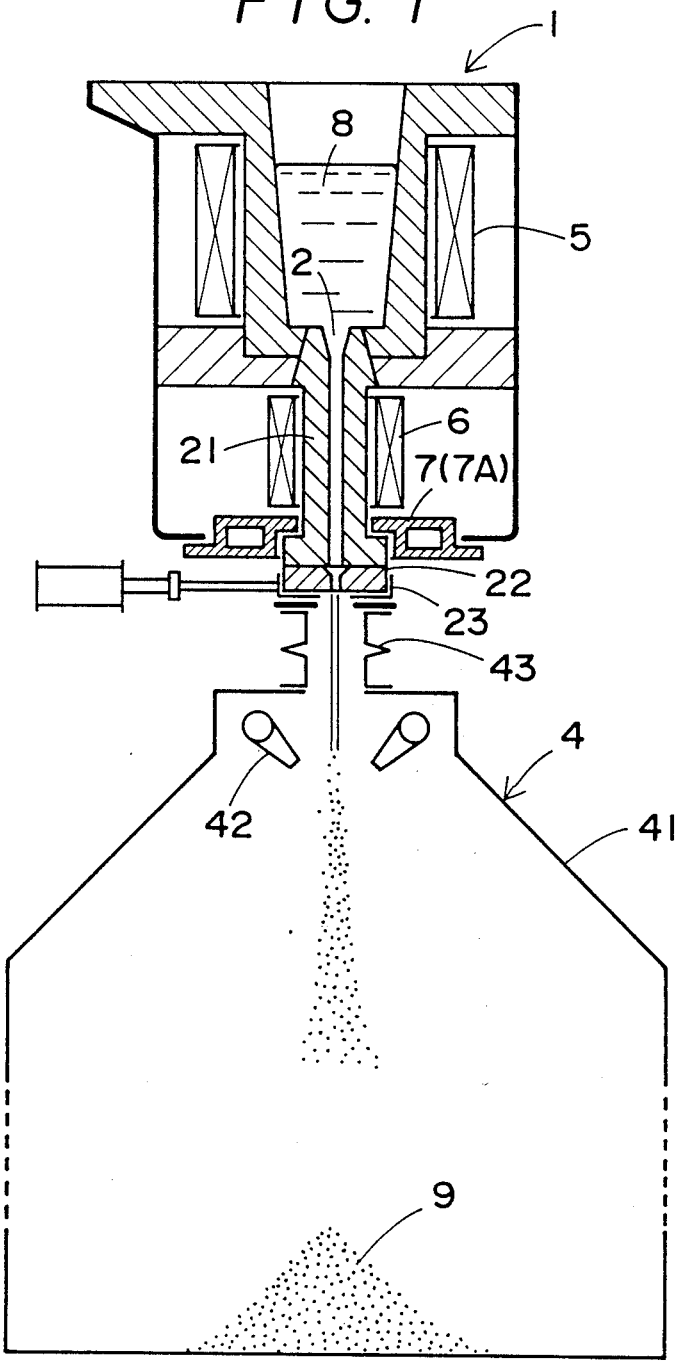
FIG. 1 is a vertical section view showing the structure of the apparatus for producing metal powder of the present invention.

The apparatus for producing metal powder of the present invention comprises, as illustrated in FIG. 1, a molten metal holding vessel 1 of bottomed cylinder shape, a molten metal discharging runner 2 installed at the bottom of the vessel, and a molten metal atomizing device 4 having gas-jetting nozzles 42 in a spraying chamber 41 TM connected to the lower end of the runner 21 with a flexible connector 43 characterized in that the apparatus is provided with an induction heating coil 6 of a smaller diameter or the second heating coil surrounding the discharging runner 2 in addition to an induction heating coil 5 of a larger diameter or the first heating coil surrounding the vessel 1; that the discharging runner 2 has an opening 2; that, the nozzle part of the discharging runner 2 is a sliding gate 22 made of a ceramic and capable of being moved by a control device 23; that a ring-shaped magnetic shielding plate 7 made of an electroconductive and non-magnetic material is disposed between the induction heating coil 5 of a smaller diameter and the sliding gate 22; and that the shielding plate is equipped with a cooling means.

The gas-jetting nozzles 42 are of course connected to an inert gas source, and the spraying chamber has a conveying means for the product powder, which are not illustrated.

Figure 7:
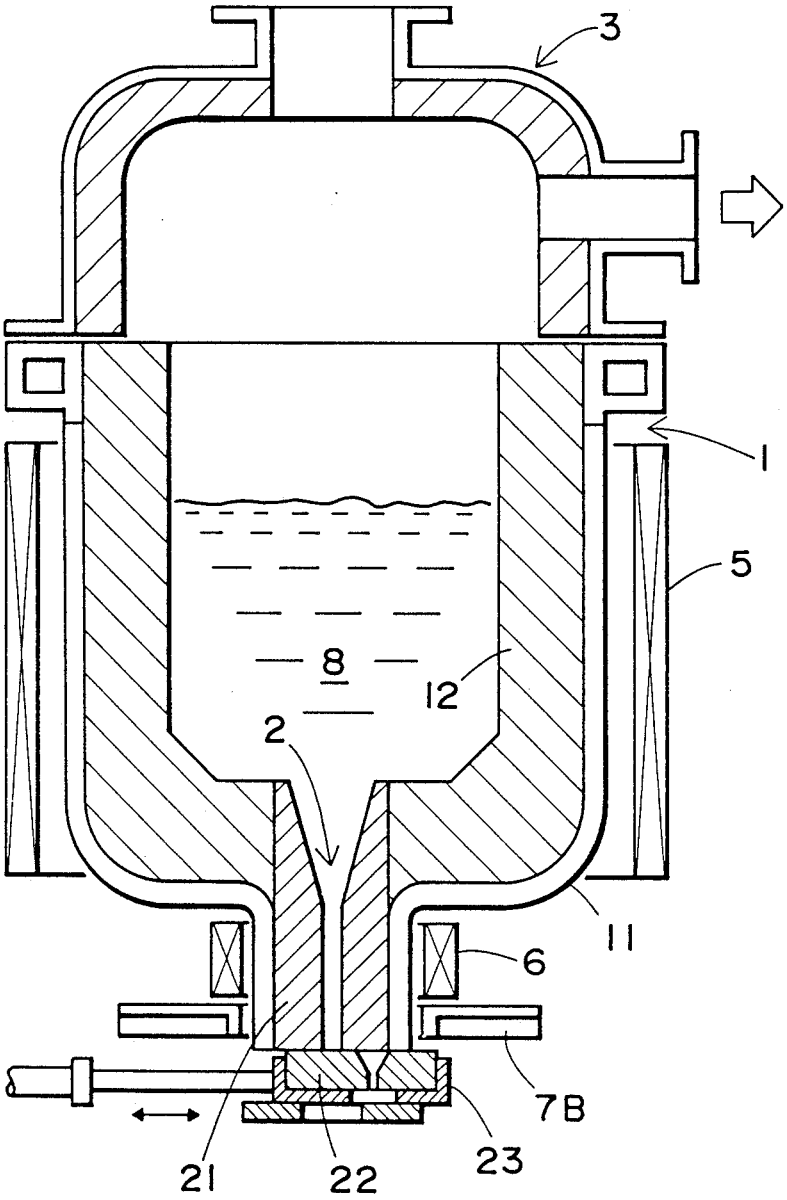
FIG. 7 is an enlarged vertical section view corresponding to the upper half of FIG. 1, which illustrates the holding vessel and the discharging runner of the preferred embodiment of the present apparatus.

In a preferred embodiment of the present apparatus for producing metal powder uses, as the molten metal holding vessel 1, as shown in FIG. 7, a combination of a vessel body made by lining the inner wall of a shell of a non-electroconductive and gas-impermeable material with refractory materials and a lid 3 which can be gas tightly joined to the body, and a vacuum generating means (not illustrated) is connected to the lid. Use of this molten metal holding vessel enables production of very clean metal powder with less contamination with air, particularly, oxygen.

Figure 3:
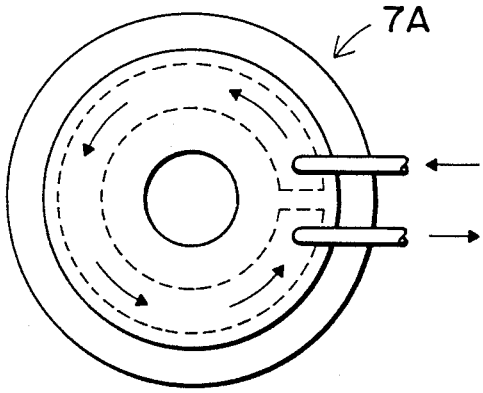
Figure 5:
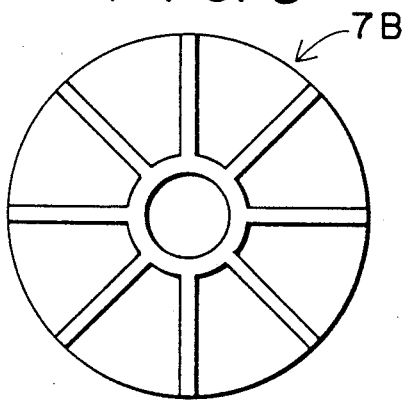

The magnetic shielding plate 7 is made of electroconductive and non-magnetic material such as copper (or aluminum or non-magnetic stainless steel) in the form of a ring as illustrated in FIG. 3 and FIG. 5, and is disposed to surround the lower end of the discharging runner 21. Because the shielding plate 7 is heated due to the induction current generated therein, it is necessary to provide a cooling means.

Figure 2:
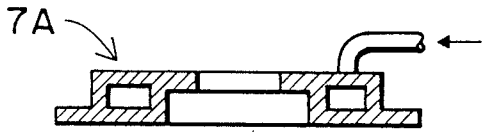
FIGS. 2 and 3 illustrate an example of the magnetic shielding plate used in the present apparatus, FIG. 2 being an axial section view, and FIG. 3, a plan view.
Figure 4:
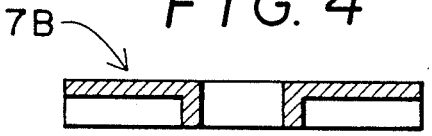
FIGS. 4 and 5 illustrate another example of the magnetic shielding plate, FIG. 4 being an axial section view, and FIG. 5, a bottom view.

An example of a first embodiment of the magnetic shielding plate 7A is shown in FIGS. 2 and 3 as being a hollow body, and cooled by circulation of a cooling medium therein as shown with arrows in FIG. 3. The cooling medium may be air, but water is preferable. A second embodiment of the magnetic shielding plate 7B is shown in FIGS. 4 and 5 as being an air-cooling type. This plate is preferably cooled by blowing air from the bottom with a fan (not illustrated).

The sliding gate 22 which is made of ceramics can be opened and closed by synchronized advancing and backward movement of two pushrods of oppositely installed hydraulic cylinders, i.e., by only pushing force in either directron.

At the use of the molten metal holding vessel shown in FIG. 7, if the sliding gate is manipulated only by advancing movement of the pushrods, it is not necessary that the sliding gate and the pushrods are connected, and the discharging runner can be pulled out together with the vessel from the first and second heating coils 5 and 6 when both the opposite pushrods are pulled back. Namely, it is possible to construct the vessel body and the lid as portable type so that they may be handled separately from the other parts, the first and the second heating coils 5 and 6, the hydraulic cylinders and the means for atomizing molten metal 8. Connection between the lower end of the discharging runner 2 and the spraying chamber 41 can be made gastite by using a flexible joint and a suitable sealing means.

This apparatus for producing metal powder is operated as follows. At first, a molten metal is charged in the holding vessel 1, while the sliding gate is closed. The molten metal may be prepared either in other melting apparatus or in this vessel by placing the materials and melting them with the first heating coil 5. Then, in case of the preferred embodiment where the molten metal is held under vacuum, while high frequency current is applied to the first heating coil to keep the temperature of the molten metal, a lid 3 is placed on the vessel and the space above the molten metal 8 is evacuated with a vacuum generating means (not illustrated). Evacuation prevents contamination with oxygen, and performs degassing to some extent. If necessary, it is possible to carry out supplemental refining by adding refining agents or adjustment of alloy composition.

When the desired molten metal is prepared under air or vacuum, the metal in the discharging runner, which was solid during the above operation, is heated to melt by applying current to the second heating coil 6, and the sliding gate 22 is opened. The molten metal runs through the discharging runner 2 and flows down from the nozzle into the spraying chamber 41, where it is sprayed by jetting inert gas, typically, nitrogen or argon, to form the metal powder 9. The gas-atomizing can be practiced in accordance with the known technology.

Figure 6:
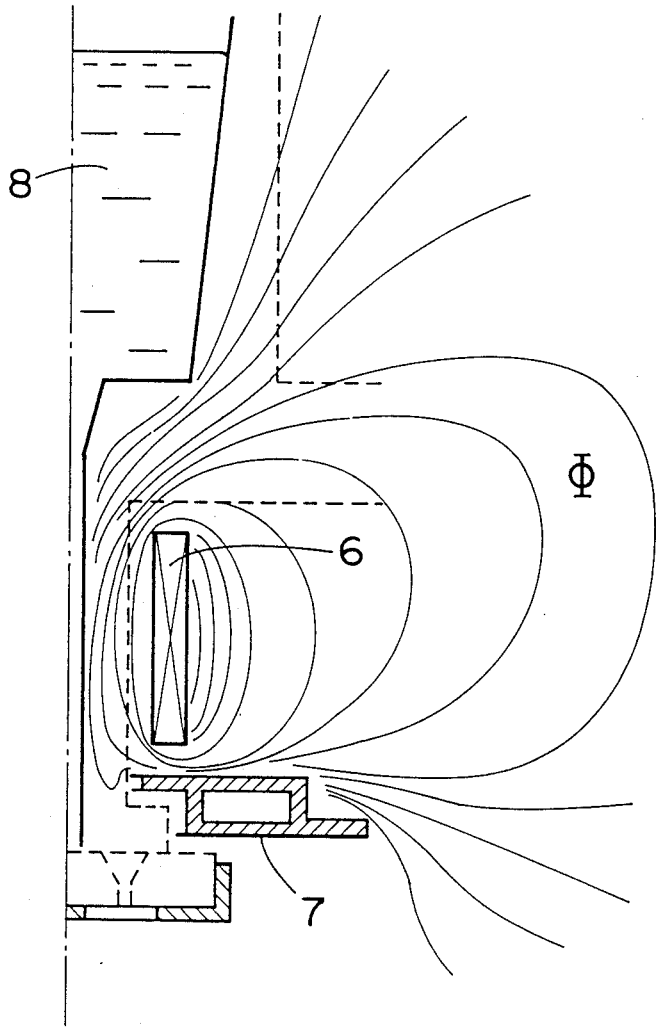
FIG. 6 is to explain the shielding of the flux in the present apparatus.

During the above discharging, the molten metal in the discharging runner is heated by flux from the second heating coil 6, but, as shown in FIG. 6, the magnetic shielding plate 7 prevents extention of the flux to the sliding gate, and thus, temperature increase of the sliding gate and loss of the flux by the sliding gate is avoided.

When the level of the molten metal went down by progress of discharging, it is possible to keep the discharging rate by increasing the pressure in the space above the molten metal (in case of the operation under vacuum, extent of pressure reduction is decreased, for example, from 200 Torr to 400 Torr). This is preferable in view of obtaining a metal powder of uniform quality.

In the apparatus of the present invention, the metal in the discharging runner is heated by induction so that the metal may be discharged in the state of high fluidability. Due to the magnetic shielding plate disposed between the second heating coil and the sliding gate, the flux from the coil does not extend to the sliding gate. Therefore, it is not necessary to consider the structure and the material of the sliding gate.

Because the flux does not reach the sliding gate, no loss of the flux occurs at the sliding gate, and because the magnetic shielding plate is made of non-magnetic material, the loss of flux in the shielding plate is very small. Thus, the present apparatus decreases loss of the flux and satisfies the demand for energy-saving.

Cooling of the magnetic shielding plate with a cooling medium makes it possible to form the shielding plate compact. In other words, the space occupied by the magnetic shielding plate between the second heating coil and the sliding gate is small, and substantially there is no space where the induction heating is not applicable due to the magnetic shielding plate at the lower part of the discharging runner. Thus, discharging may not be prevented by solidification of the metal in the discharging runner.

At discharging the molten metal, decantation of the vessel is not necessary, and it is possible to discharge and interrupt discharging by application of high frequency current during a short period for induction heating and instantaneous gate opening/closing. The operation is simplified and discharge from the bottom of the vessel makes the product free of slag contamination.

In the case where the present apparatus of the preferred embodiment is used, the molten metal is held under vacuum or inert gas atmosphere, and, if desired, further refining such as degassing can be done, it is possible to prepare, clean molten metal and discharge it while keeping it under non-contaminating conditions.

If the vessels are portable and plural vessels are prepared for exclusive use corresponding to variety of steels, then the product powder is free from contamination by remaining steel, and maintenance of the apparatus is easier.

EXAMPLE

There was constructed an apparatus for producing metal powder of the type of holding the molten metal under vacuum as shown in FIG. 7. With this apparatus, powder of SKH 51 was produced by nitrogen gas atomization.

Oxygen content of the product powder was 20 ppm. This is a remarkable improvement when compared with the best product, which contains at least 80 ppm of oxygen, prepared by the operation under air.

While the invention has been particularly shown and described in reference to preferred embodiments thereof, it will be understood by those skilled in the art that changes in form and details may be made therein without departing from the spirit and scope of the invention.

We claim:

1. An apparatus for producing metal powder comprising:

a molten metal holding vessel having a generally cylindrical shaped bottom portion;

a molten metal discharging runner located at said bottom portion of said holding vessel, said discharging runner having a nozzle portion which comprises of a sliding gate made of ceramic, said sliding gate being movable for controlling the flow of said molten metal through said nozzle portion of said discharging runner;

a spraying chamber connected at a lower end portion of said discharging runner, said spraying chamber having gas-jetting nozzles;

a first induction heating coil having a diameter and surrounding said holding vessel;

a second induction heating coil surrounding said discharging runner, said second induction heating coil having a diameter smaller than a diameter of said first induction heating coil; and a ring-shaped magnetic shielding plate disposed between said second induction heating coil and said sliding gate, said shielding plate having a cooling means for cooling said shielding plate.

2. An apparatus according to claim 1, wherein the molten metal holding vessel comprises a body made by lining refractory materials on the inner wall of a shell of a non-electroconductive and gas-impermeable material; a lid gas-tightly coupled to the body; and a vacuum generating means connected to the lid 3. An apparatus according to claim 1, wherein the magnetic shielding plate is a hollow body and cooled by said cooling means having cooling water running through said hollow body.

* * * * *